US005919125A

United States Patent [19]

Berch

[11] Patent Number: 5,919,125

[45] Date of Patent: Jul. 6, 1999

[54] CENTRIFUGE BOWL FOR AUTOLOGOUS BLOOD SALVAGE

[75] Inventor: Stephen William Berch, Arvada, Colo.

[73] Assignee: COBE Laboratories, Inc., Lakewood, Colo.

[21] Appl. No.: 08/891,471

[22] Filed: Jul. 11, 1997

[51] Int. Cl.[6] ..... B04B 1/06; B04B 7/08

[52] U.S. Cl. ..... 494/67; 494/41; 494/43; 494/65

[58] Field of Search ..... 494/41, 43, 65, 494/67

[56] References Cited

U.S. PATENT DOCUMENTS

| | | | |
|---|---|---|---|
| 3,409,213 | 11/1968 | Latham, Jr. . | |
| 3,411,450 | 11/1968 | Clifton . | |
| 3,470,824 | 10/1969 | O'Connor . | |
| 3,487,784 | 1/1970 | Rafferty et al. . | |
| 3,647,324 | 3/1972 | Rafferty et al. . | |
| 3,785,549 | 1/1974 | Latham, Jr. . | |
| 3,957,389 | 5/1976 | Rafferty et al. . | |
| 3,970,408 | 7/1976 | Rafferty et al. . | |
| 4,037,984 | 7/1977 | Rafferty et al. . | |
| 4,059,108 | 11/1977 | Latham, Jr. . | |
| 4,086,924 | 5/1978 | Latham, Jr. . | |
| 4,135,253 | 1/1979 | Reich et al. . | |
| 4,185,617 | 1/1980 | Hutchins . | |
| 4,257,744 | 3/1981 | Watson . | |
| 4,300,717 | 11/1981 | Latham, Jr. . | |
| 4,304,532 | 12/1981 | McCoy . | |
| 4,352,646 | 10/1982 | Laing et al. . | |
| 4,380,416 | 4/1983 | Menager . | |
| 4,408,952 | 10/1983 | Schweingurter . | |
| 4,589,822 | 5/1986 | Clausen et al. . | |
| 4,606,698 | 8/1986 | Clausen et al. . | |
| 4,643,641 | 2/1987 | Clausen et al. . | |
| 4,668,214 | 5/1987 | Reeder | 494/37 |
| 4,678,409 | 7/1987 | Kurokawa . | |
| 4,684,361 | 8/1987 | Feldman et al. | 494/41 |
| 4,688,998 | 8/1987 | Olsen et al. . | |
| 4,722,661 | 2/1988 | Mizuno . | |
| 4,898,518 | 2/1990 | Hubbard et al. . | |
| 4,943,273 | 7/1990 | Pages | 494/41 |
| 4,983,158 | 1/1991 | Headley | 494/41 |
| 4,984,972 | 1/1991 | Clausen et al. . | |
| 5,021,048 | 6/1991 | Buckholtz . | |
| 5,141,486 | 8/1992 | Antwiler | 494/37 |
| 5,147,186 | 9/1992 | Buckholtz . | |
| 5,312,319 | 5/1994 | Salter | 494/41 |
| 5,405,308 | 4/1995 | Headley et al. | 494/67 |
| 5,514,070 | 5/1996 | Pages | 494/41 |

FOREIGN PATENT DOCUMENTS

| | | |
|---|---|---|
| 0 619 145 A2 | 10/1994 | European Pat. Off. . |
| 0 664 159 A1 | 7/1995 | European Pat. Off. . |
| 0 682 953 | 11/1995 | European Pat. Off. . |
| WO 93/20860 | 10/1993 | WIPO . |

OTHER PUBLICATIONS

COBE Laboratories, Inc., "COBE BRAT 2 Operators's Manual" (undated).

Haemonetics Corporation, "Cell Saver HaemoLite 2 Autologous Blood Recovery System Owner's Operating and Maintenance Manual," Apr. 1989.

*Primary Examiner*—John Kim

*Attorney, Agent, or Firm*—Holme Roberts & Owen LLP

[57] ABSTRACT

An improved centrifuge bowl and related system is disclosed which is particularly apt for enhanced autologous blood salvage applications. The centrifuge bowl assembly includes a rotatable outer bowl, an internal spacer interconnected therewithin, and a stator assembly for introducing/removing fluid during rotation of the outer bowl and internal spacer. The outer bowl and internal spacer are configured to define a lateral passageway at the bottom of the assembly which terminates in an upward-facing port for fluid passage therethrough into an annular, cylindrical collection region. The annular port may be defined by a peripheral fin on the spacer and may be of a width that is less than the width of the cylindrical, annular collection region, wherein separated blood components (e.g. red blood cells) will accumulate across the width of the port during blood fill/wash cycles. As a result, enhanced washing is realized while maintaining throughput rates.

18 Claims, 4 Drawing Sheets

CENTRIFUGE BOWL FOR AUTOLOGOUS BLOOD SALVAGE

FIELD OF THE INVENTION

This invention pertains to centrifuge bowls utilized in extracorporeal blood transfer applications, and more particularly, to a centrifuge bowl that provides for fluid flow therethrough during rotation and that is particularly apt for enhanced autologous blood salvage operations.

BACKGROUND OF THE INVENTION

The popularity of autologous blood salvage continues to increase as its many advantages are recognized. Relative to the use of donor blood transfusions, the collection of a patient's blood during an intraoperative procedure and subsequent re-infusion of separated red blood cells (RBCs) into the patient reduces concerns relating to the possibility of disease transmission. The procedure also reduces concerns regarding fibrile/allergic reactions. Further, autologous blood recovery procedures provide ready RBC availability, reduced compatibility test needs, and improved RBC quality advantages.

In known autologous blood salvage techniques, blood is removed from or about a surgical site via a hand-held suction device, mixed with an anticoagulant, and transferred to a reservoir for subsequent transfer and batch processing. In connection with such collection/transfer, the blood is typically filtered to remove debris and defoamed to remove gaseous components. During processing, the blood and a wash solution are separately pumped in sequence through a rotating centrifuge to separate and wash accumulated red blood cells. Following one or more blood fill/RBC separation and wash cycles, the accumulated red blood cells are removed from the centrifuge bowl for subsequent re-infusion to the patient.

During the iterative fill/wash cycles it is important to closely control/monitor the speed and level of RBC collection in order to obtain a high quality RBC product as rapidly/efficiently as possible (e.g. to obtain a high hematocrit and high quality wash, with minimal RBC spillover in the wash solution). In this regard, the reduction of blood processing time is advantageous since, inter alia, it desirably reduces medical personnel time demands and otherwise advantageously allows for expeditious reinfusion of the RBC product to the patient.

With the increase in popularity of blood salvage techniques, heightened performance objectives are being considered. In particular, the enhanced washing of RBCs during rapid processing is of specific interest. As will be appreciated, washing of the red blood cells serves to dilute and remove soluble molecules suspended in the plasma, such as plasma-free hemoglobin and anticoagulants heparin). Additionally, activated/nonactivated clotting factors are removed. Further, it is desirable that washing remove activated platelets/white blood cells. Correspondingly, it is desirable to avoid the accumulation of deposits of white blood cells and platelets in the centrifuge bowl during processing so as to reduce any risk of removal of such deposits with the harvested RBCs. (See e.g., Bull et al., "Enhancing the Safety of Intraoperative RBC Salvage", The Journal of Trauma (March 1989)).

SUMMARY OF THE INVENTION

In view of the foregoing, a primary objective of the present invention is to provide an improved centrifuge bowl and corresponding blood processing system which achieves enhanced washing of separated blood components, and which is particularly apt for autologous blood salvage operations. In the later regard, it is an objective of the present invention to provide for the collection of a red blood cell product having a relatively high hematocrit (e.g. at least above 42% and more preferably at least about 50%), with high "washout efficiency" (e.g., providing for heparin mass reduction of at least about 98%), and wherein processing rates can be maintained at a relatively high level (e.g., blood fill rates of at least about 300 ml./min. and wash solution inlet rates of at least about 500 ml./min.).

These objectives and additional advantages are realized in the present invention which provides for the axial flow of blood into the bottom of a rotating centrifuge bowl, and resultant spinning of such blood outwardly from the bowl's center axis through a substantially lateral and radiating passageway. The blood then passes through an upwardly oriented port, or outlet, from the lateral passageway, and engages a substantially vertical sidewall of an outer bowl and accumulates in an annular fluid bed. Such fluid bed is contained in a cylindrical, annular collection ring between the sidewall of the outer bowl and a substantially vertical sidewall of an internal spacer.

By virtue of the described arrangement, at least one predetermined, heavier component of the blood to be separated and harvested for reinfusion (e.g. red blood cells)will accumulate in an outer layer of the annular fluid bed during the blood fill cycle, while other undesired components will accumulate in an inner layer of the annular fluid bed. When the inner layer of undesired compounds reaches a predetermined level (i.e. relative to the rotational axis), the undesired components will flow out of the top of the rotating bowl. The outer layer of separated components will be "packed" in a substantially uniform manner along the height of the outer layer. More particularly, while the density of collected components (e.g., RBCs) decreases according to distance from the rotational axis (i.e., less dense as distance decreases), such density gradient will be substantially uniform throughout the height of the outer layer.

Upon terminating the flow of blood into the centrifuge bowl, a predetermined volume of wash solution is flowed into the rotating bowl through the same pathway as the blood, and directed into the accumulated outer layer of separated components to achieve a degree of washing thereof. Such wash solution and additional undesired blood components washed from the outer layer will accumulate in the inner layer of the annular fluid bed during the wash cycle and will flow out of the top of the rotating bowl.

Of importance, the outer layer of separated blood component(s) will become increasing thicker (i.e. the vertical surface of the outer layer will progress towards the axis of rotation) during the blood fill cycle, while maintaining a substantially constant density gradient throughout the height of the cylindrical, annular collection region. In this regard, the thickness of the outer layer may advantageously exceed the width of the port of the lateral passageway, wherein the outer layer advantageously extends across the lateral extent of the port prior to a wash cycle. In this regard, the present invention provides for enhanced washing of the outer layer components by introducing the wash solution directly into the bottom of the accumulated outer layer of separated component(s). That is, washing of the separated component(s) is enhanced as the wash solution passes upwardly, directly therethrough and laterally therethrough (i.e., towards the rotational axis) to the inner layer where it accumulates for removal. In conjunction with such washing during blood salvage applications, the flow of the wash solution may particularly enhance removal of plasma-free hemoglobin (e.g. in cases exhibiting significant hemolysis) that may accumulate during the blood fill cycle within the outer layer together with desired red blood cells.

In this regard, it should be noted that termination of the blood fill cycle may be triggered either automatically or manually. Manual triggering may be based upon user detection of a predetermined color in a transparent outlet flow line from the centrifuge bowl. Automatic termination may be provided by positioning an optical assembly, having an infrared light source (e.g. for emitting light of a wavelength that is readily absorbed by red blood cells) and a corresponding light detector, immediately adjacent to the top of the outer centrifuge bowl (e.g. constructed of clear plastic). When the outer layer accumulates to a predetermined volume the amount of light detected will fall below a predetermined level so as to automatically terminate the fill cycle and start the wash cycle. As will be appreciated, in blood salvage applications the presence of significant levels of plasma-free hemoglobin within the outer layer comprising accumulated red blood cells can be "detected" so as to result in early termination of the fill cycle. When this occurs with the present invention, the subsequent flow of wash solution directly into the bottom of the accumulated outer layer serves to enhance separation of the plasma-free hemoglobin from the RBCs, and to effectively push the plasma-free hemoglobin out of the bowl during the wash cycle so as to enhance the hematocrit of the harvested outer layer product. When this occurs the source/detector can also be provided to detect if/when the outer layer recedes below the predetermined desired volume so as to trigger subsequent fill and wash cycles, wherein the desired volume and quality of product can be obtained.

When the desired volume of the outer layer comprising the desired, separated component (e.g. RBCs) has been accumulated and washed, the outer layer may be removed from the centrifuge bowl. For example, the centrifuge bowl may be emptied by terminating rotation of the centrifuge bowl and pressurizing the bowl so as to flow the accumulated outer layer back through the bottom passageway and axially out of the bowl for collection in a reservoir and subsequent patient reinfusion.

In accordance with the present invention, a rotatable centrifuge bowl assembly may be employed which includes a cylindrical outer bowl, a cylindrical internal spacer interconnected within the outer bowl for rotation therewith, and a stationary stator assembly for introducing fluid to and removing fluid from an annular, cylindrical collection region defined between the vertically straight, internal sidewall of the vertically straight, outer bowl and the outer sidewall of the internal spacer. During use, such annular, cylindrical collector region contains an annular fluid bed comprising inner and outer layers as noted above. The internal spacer and outer bowl are configured and interconnected so as to further define a substantially lateral, radiating passageway at the bottom of the centrifuge bowl assembly, and an annular upward facing port from such lateral passageway vertically into the cylindrical, annular collection region. Importantly, the width of the annular port is less than the width of the annular, cylindrical collection region.

Preferably, the bottom external surface of the internal spacer is substantially flat while the opposing internal surface at the bottom of the outer bowl angles slightly upward and outward to define a narrowing, central portion of the lateral passageway. Further, at the peripheral extreme of such passageway, it may be preferable to provide a passageway portion having a cross-sectional size that is maintained or even increases, wherein fluid passing through the peripheral portion is directed into the annular, collection region at an acute angle transverse to the outer layer of the annular fluid bed described above.

More particularly, an internal spacer can be employed which includes an annular, continuous fin projecting outwardly from the outer sidewall of the spacer, most preferably at and completely about the bottom peripheral extreme thereof. Such fin may advantageously extend outward a predetermined distance from the circular sidewall of the internal spacer, wherein enhanced washing benefits can be realized during use (e.g. by providing for directed passage of wash solution towards and/or directly into accumulated red blood cells during filling/washing steps). Relatedly, it has also been recognized that it may be desirable to angle a circular fin slightly upward, and most preferably by an angle at least commensurate with, and preferably greater than the upward and outward angulation of the base floor of the outer bowl. More particularly, it has been determined that a fin having an upward angulation of at least about 3° to 27° relative to horizontal is desirable, and even more desirably between about 3° and 7°.

Further, it has been determined that a fin having a predetermined length (i.e. outward extension relative to the outer sidewall surface of the internal spacer) which exceeds about 20% of the width of the annular, cylindrical collection region is preferable, and even more preferably which is between about 25% and 60%. By way of particular example, where the width of the annular, cylindrical collection region is about 0.28", it is preferable to utilize a fin length of at least about 0.06" to about 0.17".

In one embodiment, the outer bowl and internal spacer can each be of a two-piece plastic construction. Specifically, the internal spacer may comprise upper and lower members which are adjoined (e.g. with ultrasound welding) after separate molding (e.g., via injection-molding techniques). In the later regard, it has been determined that the length and angulation of the above-noted lateral passageway and outwardly extending fin can be of significant importance, and therefore reliable molding of the lower member of the internal spacer is of particular interest. Correspondingly, it has been found that, by defining (e.g., during molding) an annular recess in the bottom surface of the bottom member of the internal spacer, immediately adjacent to the outwardly extending fin, the desired configuration and orientation of the fin can be reliably maintained.

Advantages and variations of the present invention will become apparent to those skilled in the art upon further consideration.

DETAILED DESCRIPTION

Figure 1:
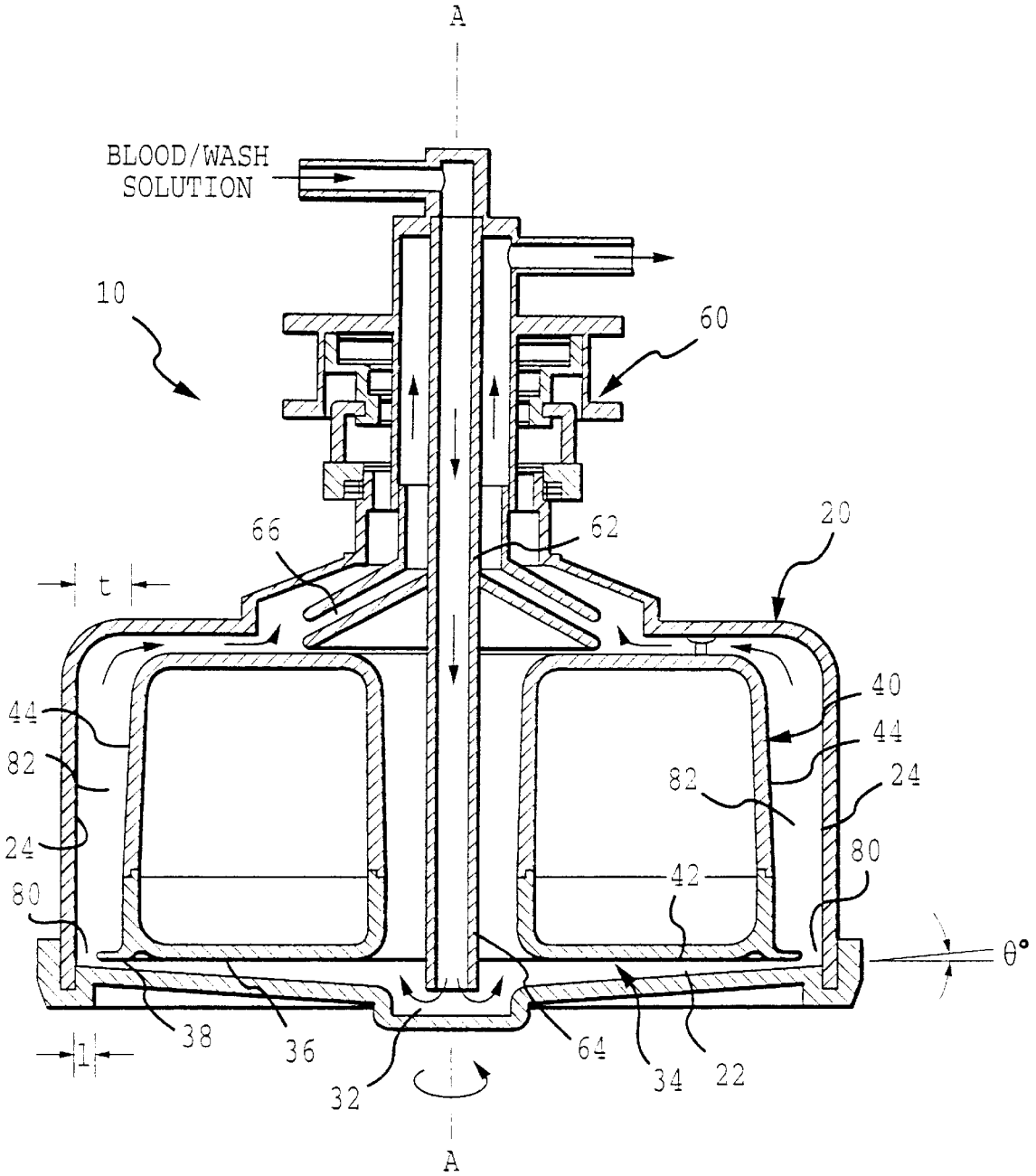
FIG. 1 illustrates a cross-sectional view of one centrifuge bowl assembly embodiment of the present invention.
Figure 2:
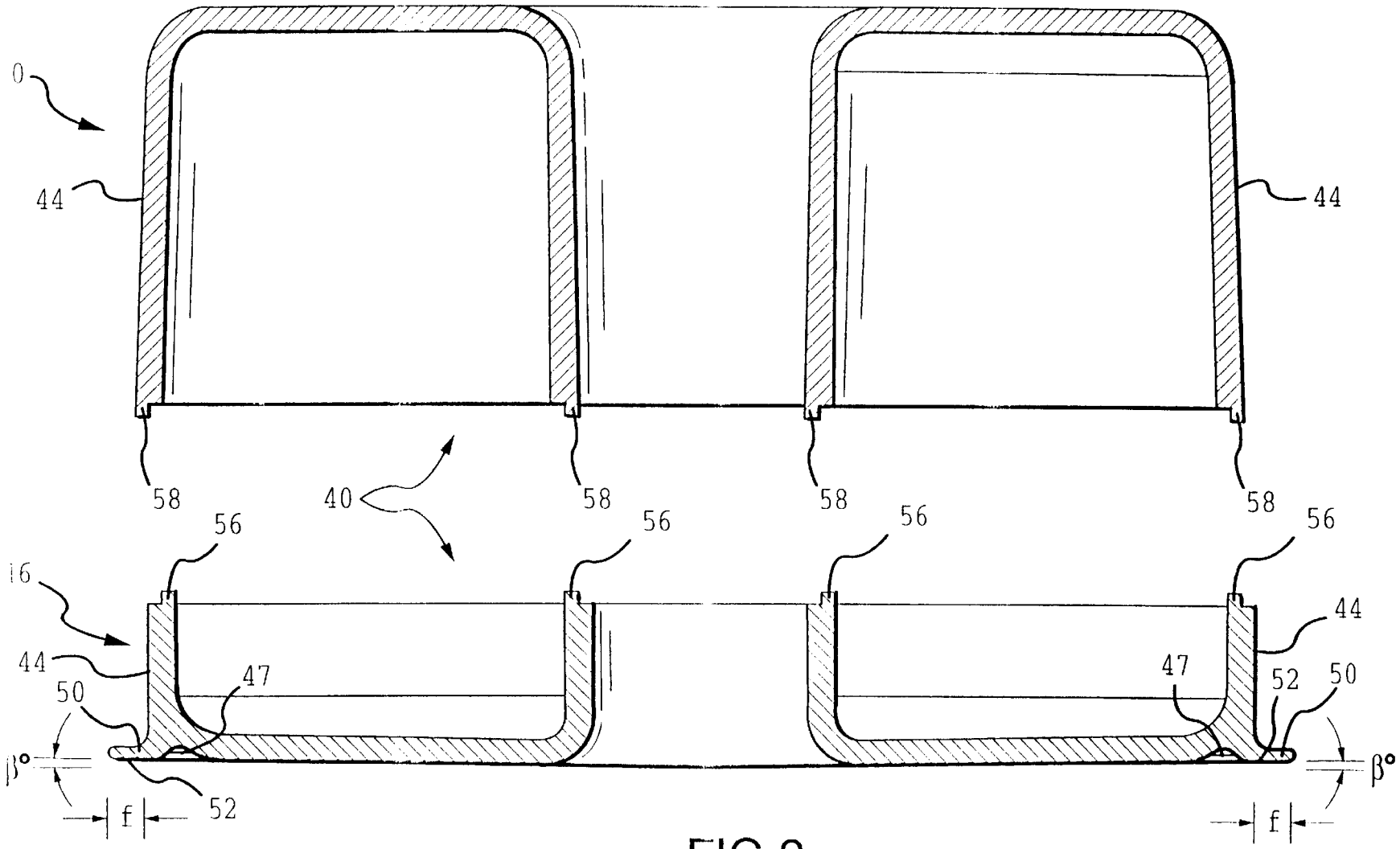
FIG. 2 is a cross-sectional assembly view of the internal spacer utilized in the embodiment of FIG. 1.

The centrifuge bowl assembly 10 illustrated in FIGS. 1–3 comprises an outer bowl 20, internal spacer 40 interconnected within outer bowl 20 for driven rotation therewith about axis AA, and a stationary stator assembly 60 for introducing/removing fluids to/from the assembly 10. The illustrated embodiment will be described in relation to an autologous blood salvage application, but it will be understood that the invention may have broader application.

As shown in FIG. 1, stator assembly 60 includes a fluid inlet tube 62 having a bottom end 64 positioned in bottom well region 32 for the sequential introduction of salvaged blood and wash solution and for removal of the harvested RBC product during use. The bottom well region 32 is fluidly interconnected to an outwardly, radiating passageway 34 defined between the internal, bottom surface 22 of the outer bowl 20 and the external, bottom surface 42 of internal spacer 40. The passageway 34 includes a narrowing, central portion 36 and peripheral portion 38. As illustrated, the central portion 36 narrows by virtue of the upward and outward sloping of the bottom surface 22 of outer bowl 20 at an angle of θ° (e.g., about 3°) relative to the horizontal bottom surface 42 of internal spacer 40. The passageway 34 terminates in an upwardly-oriented port 80 to permit salvaged blood and wash solution passage therethrough into a cylindrical, annular collection region 82 defined between the straight, inner surface of the straight, substantially vertical sidewall 24 of the outer bowl 20, and the straight, substantially vertical outer surface of sidewall 44 of the internal spacer 40. The width l of port 80 is less than the width t of the annular, collection region 82. The annular, collection region 82 is in fluid communication with fluid removal channels 66, included within the stator assembly 60, as will be further described. The stator assembly 60 provides for a rotating seal between stator assembly 60 and the outer bowl 20, e.g., as taught by U.S. Pat. No. 4,684,361.

As shown in FIG. 1, the port 80 is defined between the substantially vertical, inner surface of side wall 24 and the outer bowl 20 and the peripheral edge of an annular fin 50 protruding at and about the bottom peripheral extreme of internal spacer 40. In this regard, and as best illustrated in FIG. 2, annular fin 50 may be configured so that a bottom surface 52 of annular fin 50 angles upwardly and outwardly at an angle of β° (e.g. about 3° to about 27°, and preferably about 3° to 7°) relative to the horizontal, bottom surface 42 of internal spacer 40.

To facilitate manufacture, internal spacer 40 may comprise injection-molded bottom section 46 having annular fin 50 integrally defined therewith, and injection-molded top section 48. The bottom section 46 and top section 48 may be assembled together via interfacing projections on bottom section 46 and 58 on top section 48, respectively, wherein the bottom and top sections 46 and 48 are secured by melting the interfacing projections 56 and 58 together via ultrasonic welding during assembly. Of note, in order to maintain the desired angulation of fin 50 (i.e. at the desired angle β°), an annular recess 47 may be defined in bottom member 46 upon molding. More particularly, the inclusion of recess 47 significantly reduces any distortion of fin 50 that may otherwise occur upon cooling after molding, wherein the angulation and overall profile of fin 52 is maintained substantially uniform about the circular periphery thereof.

Preferably, fin 50 is of a length f, wherein the ratio of fin 50 length f to annular collection region 82 width t is at least about 0.2, and even more preferably between about 0.25 to 0.60. In this regard, it has been determined that, where the diameter of internal sidewall 27 of bowl 20 is 5.135", the diameter of external sidewall 44 of spacer 40 is 4.57", and the height of collection region 82 is about 2.3", fin 50 should have a length of between about 0.06" to 0.17". Specifically, in such an arrangement a fin 50 length of about 0.09", fin 50 thickness of about 0.06", and fin 50 surface 52 upward angulation β° of about 4° provides for excellent results.

Figure 3B:
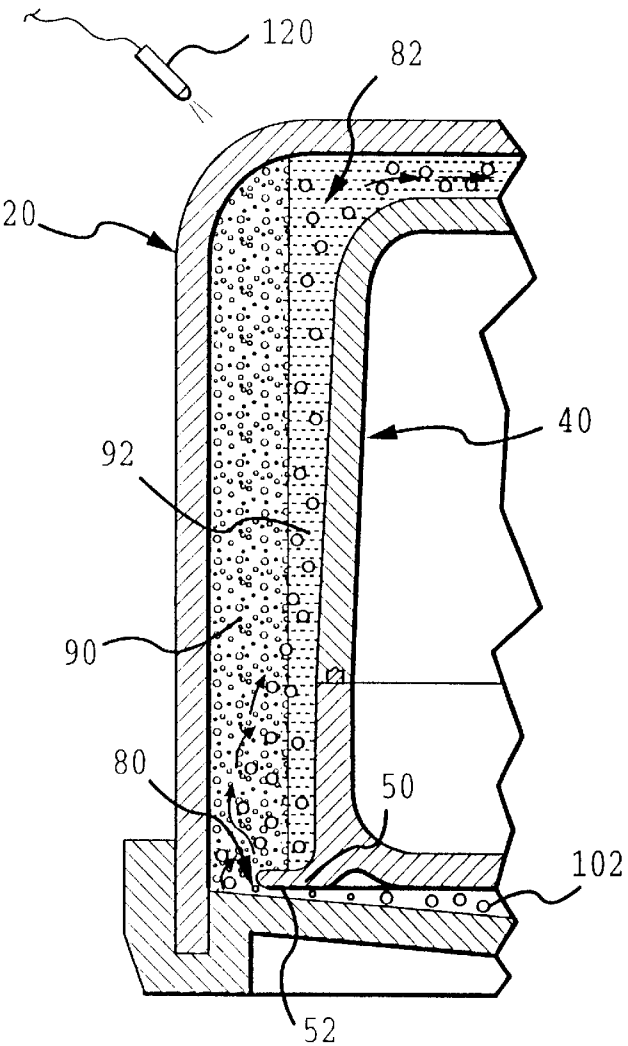
FIGS. 3A and 3B, and FIGS. 3C and 3D illustrate various stages of fill and wash cycles within the centrifuge bowl assembly embodiment of FIG. 1.
Figure 3A:
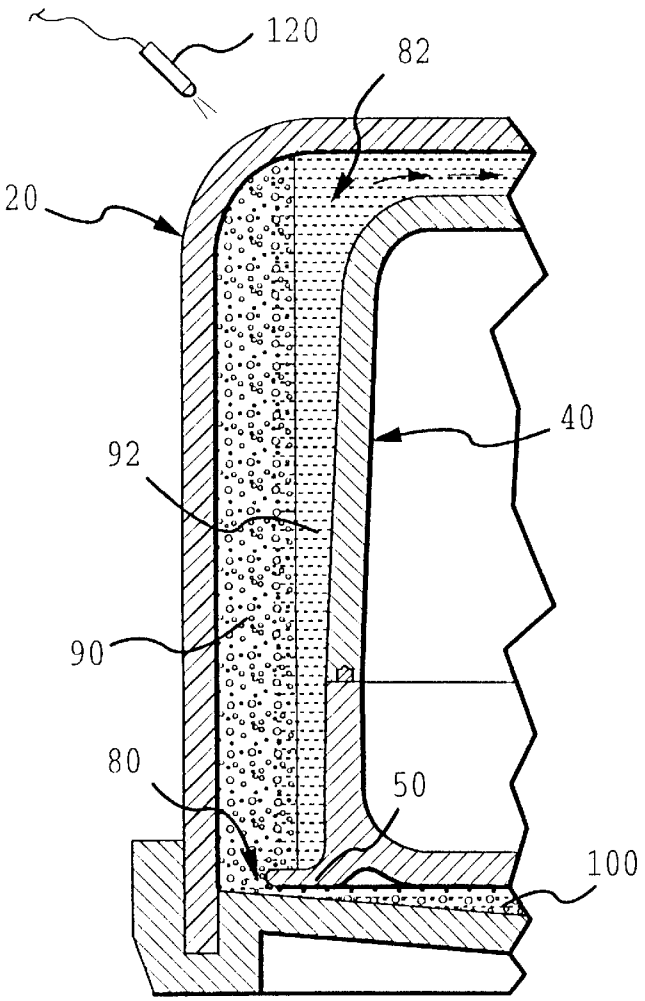

Referring now to FIGS. 3A and 3B, progressive blood fill and wash steps of an autologous blood salvage operation will be described. Generally, FIGS. 3A and 3B illustrate the successive passage of salvaged blood then wash solution into an annular collection region 82 of a rotating centrifuge bowl assembly 10, wherein red blood cells accumulate in an outer layer 90 in the annular collection region 82, and undesired blood components and wash solution accumulate and are removed from an inner layer 92 in the annular collection region 82.

More particularly, FIG. 3A illustrates introduction of salvaged blood 100 during a filling step. As shown, salvaged blood 100 passes through passageway 34 and into the annular collection region 82 via port 80. By virtue of the rotation of the outer bowl 20 and internal spacer 40, red blood cells are accumulated in an outer layer 90, undesired blood components accumulate in an inner layer 92. Such undesired components may include, for example, an anticoagulent (e.g. heparin), white blood cells and platelets, plasma-free hemoglobin and activated/inactivated clotting factors.

As shown, red blood cells will continue to accumulate in the outer layer 90 while the undesired components accumulate in the inner layer 92 and are removed through passageway 66 (not shown in FIG. 3A). Of importance, it can be seen that the outer layer 90 accumulates to a thickness sufficient to completely cover port 80.

Of related importance, due to the configuration at bowl 20 and spacer 40, the density gradient across and thickness of the outer layer 90 is substantially constant along the vertical extent thereof. As a result, relatively high blood fill rates (e.g. at least about 300 ml./min., and most typically about 400 ml./min., for 250 ml. bowl containment volume) and relatively high wash solution input rates (e.g. at least about 500 ml./min., and most typically about 800 ml./min., for 250 ml. bowl containment volume) can be realized.

In the latter regard, FIG. 3A illustrates the inclusion of an optical sensor assembly 120 positioned adjacent to the top of outer bowl 20 for detecting when the outer layer 90 reaches a predetermined volume so as to automatically terminate the salvaged blood filling step and initiate the wash step. Such predetermined volume may be advantageously selected to provide for outer layer 90 coverage of port 80. By way of example, optical sensor assembly 120 may include an infrared light source and detector for emitting and detecting light having a predetermined center-wavelength that will generally be more readily absorbed by red blood cells than undesired components accumulating in layer 92. Therefore, since optical sensor assembly 120 is angled (e.g. at about 45°), emitted light will pass through the clear bowl 20 and reflect off of the upper radius of spacer 40 (i.e. adjoining the sidewall 44 and top of spacer 40) and back to optical assembly 120 at a predetermined minimum intensity level until/unless the outer layer 90 has accumulated to the above-noted, predetermined volume. At that point, the red blood cells in outer layer 90 will effectively block the light from returning to optical assembly 120 and thereby trigger the noted response.

FIG. 3B illustrates a wash cycle during which a predetermined volume of wash solution 102 (e.g., 1000 ml. of saline solution for a 250 ml. bowl containment volume) is introduced through the passageway 34 and port 80 into the annular collection region 82. More particularly wash solution 102 is introduced directly into the bottom of outer layer 90. Further, due to the rotation of outer bowl 20 and inner bowl spacer 40, as well as the upward and outward angulation of the bottom surface 52 of fin 50 (e.g. at about 4° relative to horizontal), at least a portion of wash solution 102 is directed through vertical port 80 at an acute, upward angle relative to horizontal. As will be appreciated, such flow of wash solution 102, when coupled with the uniform packing of red blood cells within outer layer 90, allows an enhanced degree of washing to be realized by the present invention. That is, wash solution 102 will penetrate and mix into outer layer 90 so as to contact and wash undesired components from the red blood cells. In this regard, it will be appreciated that enhanced washing is achieved in the present invention by virtue of the position and configuration of port 80 and fin 50 as well as the vertical configuration of the sidewalls 24 and 44 of bowl 20 and spacer 44, respectively.

Figure 3D:
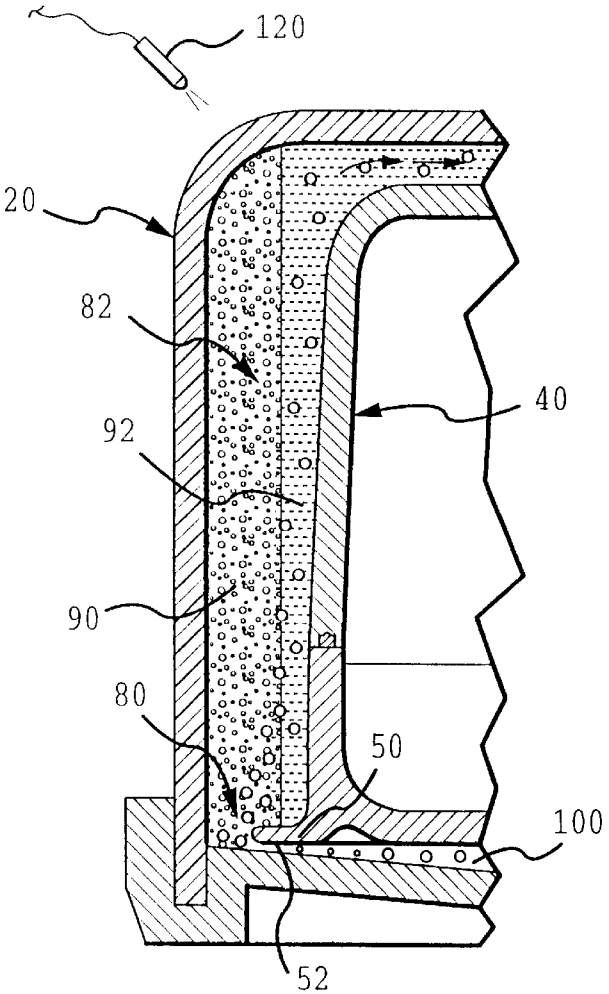
Figure 3C:
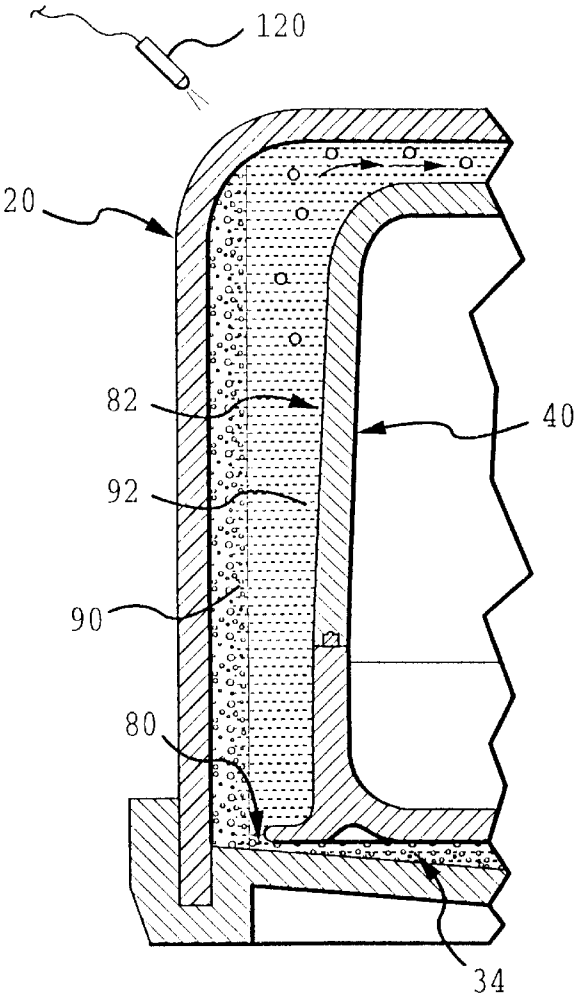

FIG. 3C illustrates a second filling step, wherein additional salvaged blood 100 is introduced through passageway 34 into collection region 82. As shown, the red blood cells continue to accumulate in the outer layer 90 while the undesired components accumulate in the inner layer 92 for removal through passageway 66 (not shown). Of importance, it can be seen that at the end of the second filling step (i.e. FIG. 3D) the outer layer 90 is again thick enough to completely cover port 80.

FIG. 3D shows a second washing step, wherein wash solution 102 is introduced directly into the bottom of outer layer 90. As will be appreciated, such flow of wash solution 102, when coupled with the uniform packing of red blood cells within outer layer 90, allows an enhanced degree of washing to be realized. In this regard, the wash solution 102 is able to move through and contact a significant portion of the RBC's within outer layer 90.

It should be noted that when there is significant hemolysis in the salvaged blood, a relatively large amount of plasma-free hemoglobin may accumulate during filling with the red blood cells in the outer layer 90 and thereby trigger detection by optical sensor assembly 120. Should this occur in use of the present invention, the wash cycle illustrated in FIG. 3B provides for enhanced washing of plasma-free hemoglobin from the red blood cells and will effectively "push" out the plasma-free hemoglobin via passageway 66. As such, and as shown in FIG. 3C, upon completion of the wash step, the accumulated outer layer 90 comprising the red blood cells may recede to a volume less than the predetermined desired volume that triggered termination of the initial filling step and initiation of the initial wash step.

In such instances, the sensor assembly 120 may be provided so as to detect such condition, wherein a second filling step can be automatically initiated and carried out as shown in FIG. 3D. Such second filling step may be terminated in the same manner as described above in relation to FIGS. 3A and 3B. Iterative fill and wash steps may continue until the desired predetermined volume of the outer layer 90 comprising red blood cells is achieved.

When a predetermined, desired volume of outer layer 90 is obtained, the outer layer may be emptied from bowl 20 via tube 62. For example, rotation of bowl 20 may be terminated and bowl 20 may be pressurized so as to cause the accumulated RBC-containing product to flow through port 80, passageway 34 and out of the bowl via tube 62. The harvested product may then be collected in a reservoir for subsequent patient reinfusion.

By virtue of the enhanced washing provided by the present invention, an improved RBC blood product can be attained. Specifically, mass anticoagulant removal of at least about 98% can be realized. That is, for example, where the blood introduced for processing comprises a given number of units of anticoagulent (e.g. heparin), at least about 98% of the mass of such anticoagulent may be removed via washing, wherein the final, outer layer of RBC-containing product includes less than about 2% of the mass of the anticoagulant. Further, the enhanced washing can be obtained while maintaining blood fill rates into bowl 20 of at least about 300 ml./min. and more typically about 400 ml./min., and wash solution inlet rates of at least about 500 ml./min. at more typically about 800 ml./min. Additionally, the resultant RBC product can be provided with a hematocrit of above about 42%, and more typically of at least about 50%.

EXAMPLE

Comparative testing of the present invention and a prior art device, as taught by U.S. Pat. No. 4,684,361, has confirmed that the present invention yields enhanced red blood cell washing, while maintaining a relatively high hematocrit. In particular, such testing reflects a capability to decrease heparin loading in the resultant red blood cell product by more than 50% relative to such prior art device.

In the test, both the prior art device and an embodiment of the present invention, as described above, were sized to define an annular collection region having a volume of 250 ml. The devices utilized in the testing were commonly configured except for the inclusion of a fin 50 on internal spacer 40 in the inventive embodiment, such fin having a length of about 0.12" and defining a port 80 width of about 0.174". Multiple fill/wash cycles were conducted with a common protocol utilizing plasma dilute blood. The results of the study are set forth in Table 1. As will be appreciated, these results indicate that total heparin mass reduction is enhanced with the present invention relative to the prior art device.

TABLE 1

| | Cycle | Plasma Dilute Blood In (ml) | Wash Vol. (ml.) | Inlet Heparin Mass (units/ml.) | Outlet Heparin Mass (units/ml.) | Heparin Mass Reduction (units/ml.) |
|---|---|---|---|---|---|---|
| Prior Art | 1 | 835 | 1000 | 3193.88 | 167.27 | 94.76% |
| Device | 2 | 828 | 1000 | 3167.10 | 195.00 | 93.84% |
| | 3 | 832 | 1000 | 3182.40 | 212.54 | 93.32% |
| Present | 1 | 764 | 1000 | 3441.82 | 73.29 | 97.87% |
| Invention | 2 | 835 | 1000 | 3761.68 | 78.41 | 97.92% |
| | 3 | 831 | 1000 | 3743.66 | 75.90 | 97.97% |

What is claimed is:

1. A centrifuge bowl assembly for extracorporeal blood processing, including:

a rotatable cylindrical outer bowl having a bottom internal surface and an adjoining substantially vertical, internal sidewall;

a cylindrical internal spacer, interconnected within said outer bowl for driven rotation therewith, said internal spacer having a bottom external surface an adjoining substantially vertical, external sidewall, and an annular fin having a peripheral edge, said fin extending outwardly from said external sidewall of said spacer, wherein the bottom internal surface of said outer bowl and the bottom external surface of said internal spacer define an outwardly extending passageway therebetween terminating in an annular, upward-facing port between said peripheral edge of said fin and said outer bowl internal sidewall, said port having a first width, and wherein said substantially vertical, internal sidewall of said outer bowl and the substantially vertical, external sidewall of said internal spacer define a substantially cylindrical, annular collection region therebetween, said substantially cylindrical, annular collection region being in fluid communication with said annular, upward-facing port and having a second width greater than said first width of said port;

a stator assembly, interconnected to a top end of said outer bowl, for introducing blood and a wash solution into said passageway and to remove the wash solution and undesired blood components in the introduced blood from said cylindrical, annular collection region during rotation of said outer bowl and internal spacer, wherein red blood cells in the introduced blood accumulate in order substantially cylindrical annular ring immediately adjacent to said substantially vertical, internal sidewall of said outer bowl, said outer ring of accumulated red blood cells having a substantially uniform thickness and being packed substantially uniformly along the height thereof, and said outer ring of accumulated red blood cells having a substantially uniform density gradient along the height of the outer ring, wherein said outer ring of red blood cells accumulates to a thickness sufficient to cover said port prior to introduction of wash solution, and wherein during introduction of wash solution at least a portion of said wash solution flows through said port and said wash solution is directed by said fin into the bottom of said outer ring to wash said accumulated red blood cells, said wash solution and additional blood components accumulating in an inner layer of the annular collection region.

2. A centrifuge bowl as recited in claim 1, wherein said passageway includes a central portion and an adjoining peripheral portion, said peripheral portion being disposed between the bottom internal surface of the outer bowl and said annular fin extending outwardly from said external sidewall of said internal spacer.

3. A centrifuge bowl as recited in claim 2, wherein said peripheral portion is flared relative to said central portion.

4. A centrifuge bowl as recited in claim 2, said fin having a bottom surface which angles upwardly and outwardly at an angle of between about 3° and 27° relative to horizontal, wherein said wash solution is directed into said annular collection region at an acute angle transverse to said outer ring of accumulated red blood cells.

5. A centrifuge bowl as recited in claim 4, wherein said bottom surface of said fin angles upwardly and outwardly at an angle of between about 3° and 7° relative to horizontal.

6. A centrifuge bowl as recited in claim 2, wherein said fin is of a length which is at least about 20 percent of said width of said cylindrical, annular collection region.

7. A centrifuge bowl as recited in claim 2, wherein said fin angles upwardly and outwardly at an angle of between about 3° and 7° and has a length of at least about 25 percent to 60 percent of the width of said cylindrical, annular collection region.

8. A centrifuge bowl as recited in claim 2, said bottom internal surface of said outer bowl being angled upwardly and outwardly, wherein said central portion of said passageway narrows as it radiates outward.

9. A centrifuge bowl as recited in claim 8, said fin being angled upwardly and outwardly at an angle at least equal to an inclination angle of said bottom internal surface of said outer bowl.

10. A centrifuge bowl assembly as recited in claim 9, said fin being angled upwardly and outwardly at an angle greater than an inclination angle of said bottom internal surface of said outer bowl.

11. A centrifuge bowl assembly as recited in claim 2, wherein a bottom surface of said fin angles upwardly and outwardly at an angle of between about 3 degrees and 7 degrees relative to horizontal wherein said internal spacer comprises a bottom member defining the entirety of said bottom external surface of said internal spacer, and wherein an annular recess is integrally formed in said bottom member immediately adjacent to and in concentric relation to the entirety of said fin.

12. A centrifuge bowl assembly for extracorporeal blood processing, including:

a rotatable cylindrical outer bowl having a bottom internal surface and an adjoining substantially vertical, internal sidewall;

a cylindrical internal spacer, interconnected within said outer bowl for driven rotation therewith having a bottom external surface and an adjoining a substantially vertical, external sidewall, said internal spacer comprising at least top and bottom members of molded plastic construction, wherein the bottom internal surface of said outer bowl and the bottom external surface of said internal spacer define an outwardly extending passageway, said passageway includes a central portion and an adjoining peripheral portion, said peripheral portion being disposed between the bottom internal surface of the outer bowl and an annular fin extending outwardly from said internal sidewall of said internal spacer, said passageway therebetween terminating in an annular, upward-facing port having a first width, and wherein said substantially vertical, internal sidewall of said outer bowl and the substantially vertical, external surface of said internal spacer define a substantially cylindrical, annular collection region therebetween, said cylindrical, annular collection region being in fluid communication with said annular, upward-facing port and having a second width greater than said first width of said port, said bottom member including said fin and having an annular recess in the bottom external surface immediately adjacent to said fin;

a stator assembly, interconnected to a top end of said outer bowl, for introducing blood and a wash solution into said passageway and to remove the wash solution and undesired blood components from said cylindrical, annular collection region during rotation of said outer bowl and internal spacer, wherein red blood cells accumulate in an outer, annular ring immediately adjacent to said vertical, internal sidewall, said outer ring of accumulated red blood cells being packed substantially uniformly along the height thereof.

13. A centrifuge assembly for extracorporeal blood processing, including;

a rotatable cylindrical outer bowl;

a cylindrical internal spacer interconnected with said outer bowl for driven rotation therewith, wherein said outer bowl and internal spacer define a bottom, outwardly extending passageway therebetween terminating in an annular, upward-facing port having a first width, said passageway including a central portion and a peripheral portion disposed between the outer bowl and an annular fin extending from said internal spacer, and wherein said outer bowl has a substantially vertical internal sidewall and said internal spacer has a substantially vertical external surface to define a substantially cylindrical, annual collection region therebetween, said collection region being in fluid communication with said annular, upward-facing port and having a second width greater than said first width; and a stator assembly for introducing blood and a wash solution into said bottom passageway and to remove the wash solution and undesired blood components in the introduced blood during rotation of said outer bowl and internal spacer, wherein red blood cells in the introduced blood accumulate in an outer, substantially cylindrical annual ring immediately adjacent to said substantially vertical, internal sidewall of the outer bowl, said outer ring of accumulated red blood cells having a substantially uniform thickness and being packed substantially uniformly along the height thereof, and said outer ring of accumulated red blood cells having a substantially uniform density gradient along the height of the outer ring, wherein said outer ring of red blood cells accumulates to a thickness sufficient to cover said port prior to introduction of wash solution, and wherein during introduction of wash solution at least a portion of said wash fluid solution flows through said port and said wash solution is directed by said fin into the bottom of said outer ring to wash said accumulated red blood cells, said wash solution and additional blood components accumulating in an inner layer of the annular collection region.

14. A centrifuge assembly as recited in claim 13, wherein said central portion of said bottom passageway becomes narrower as it extends outward, and wherein said peripheral portion of said bottom passageway is flared relative to an outer end of said central portion of said bottom passageway.

15. A centrifuge assembly as recited in claim 13, wherein said fin angles upwardly and outwardly at an angle of between about 3 degrees and 7 degrees and has a length of at least about 25% to 60% of the width of the cylindrical, annular collection region, wherein said wash solution is directed into said annular collection region at an acute angle transverse to said outer ring of accumulated red blood cells.

16. A centrifuge assembly as recited in claim 13, wherein after introduction of wash solution the outer ring of accumulated red blood cells is washed to form a washed red blood cell product having a hematocrit above about 42%.

17. A centrifuge assembly as recited in claim 13, wherein said blood and said wash solution are introduced into said bottom passageway at rates of at least about 300 ml./min. and at least about 500 ml./min., respectively.

18. A centrifuge assembly as recited in claim 13, wherein said introduced blood includes an anticoagulant, and where said washing provides for a mass anticoagulant removal of at least about 98%.

* * * * *